US012497891B2

(12) United States Patent
Rataj et al.

(10) Patent No.: US 12,497,891 B2
(45) Date of Patent: Dec. 16, 2025

(54) ROCK BOLT

(71) Applicant: SANDVIK MINING AND CONSTRUCTION AUSTRALIA (PRODUCTION/SUPPLY) PTY LTD, Queensland (AU)

(72) Inventors: Mietek Rataj, New South Wales (AU); Bradley Darlington, New South Wales (AU)

(73) Assignee: Sandvik Mining and Construction Australia (Production/Supply) Pty Ltd, Milton (AU)

( * ) Notice: Subject to any disclaimer, the term of this patent is extended or adjusted under 35 U.S.C. 154(b) by 84 days.

(21) Appl. No.: 18/705,137

(22) PCT Filed: Oct. 27, 2022

(86) PCT No.: PCT/AU2022/051289
§ 371 (c)(1),
(2) Date: Apr. 26, 2024

(87) PCT Pub. No.: WO2023/070155
PCT Pub. Date: May 4, 2023

(65) Prior Publication Data

US 2025/0034998 A1 Jan. 30, 2025

(30) Foreign Application Priority Data

Oct. 28, 2021 (EP) ..... 21205283

(51) Int. Cl.
*E21D 21/00* (2006.01)

(52) U.S. Cl.
CPC ..... *E21D 21/0033* (2013.01); *E21D 21/008* (2013.01)

(58) Field of Classification Search
CPC .. E21D 21/0033; E21D 21/004; E21D 21/008
See application file for complete search history.

(56) References Cited

U.S. PATENT DOCUMENTS 3,938,420 A * 2/1976 Draa ..... E21D 21/008 411/53
4,011,787 A * 3/1977 White ..... F16B 13/066 411/53
5,556,233 A * 9/1996 Kovago ..... E21D 21/006 405/259.4
2012/0163924 A1 6/2012 Rataj
2015/0368894 A1* 12/2015 Bennett ..... E04B 1/383 52/309.3

(Continued)

FOREIGN PATENT DOCUMENTS

AU 2006252086 A1 7/2008
AU 2010223134 B2 8/2012

(Continued)

*Primary Examiner* — Benjamin F Fiorello
(74) *Attorney, Agent, or Firm* — Corinne R. Gorski

(57) ABSTRACT

A rock bolt includes a central rod, a tubular outer body provided around the central rod, and an expansion mechanism arranged for radially expanding the leading portion of the outer body. The rock bolt is arranged such that the outer body at installation is pulled into a bore of a formation from the leading portion of the outer body using a driving force applied via the central rod.

16 Claims, 4 Drawing Sheets

(56) References Cited

U.S. PATENT DOCUMENTS

| | | | | |
|---|---|---|---|---|
| 2020/0063556 | A1 | 2/2020 | Darlington et al. | |
| 2020/0063557 | A1* | 2/2020 | Pastorino | E21D 21/004 |
| 2020/0277857 | A1 | 9/2020 | Catoi | |
| 2021/0172318 | A1* | 6/2021 | Rataj | E21D 21/00 |

FOREIGN PATENT DOCUMENTS

| | | | |
|---|---|---|---|
| CZ | 25706 | U1 | 7/2013 |
| EP | 0861969 | A1 | 9/1998 |
| EP | 3613943 | A1 | 2/2020 |
| WO | 2010006374 | A1 | 1/2010 |
| WO | 201513743 | A1 | 2/2015 |
| WO | 2018206628 | A1 | 11/2018 |

* cited by examiner

ROCK BOLT

RELATED APPLICATION DATA

This application is a § 371 National Stage Application of PCT International Application No. PCT/AU2022/051289 filed Oct. 27, 2022 with priority to EP 21205283.1 filed on Oct. 28, 2021, the contents of which are incorporated herein by this reference.

TECHNICAL FIELD

The present disclosure relates to bolts for reinforcement of formations, such as rock strata, and specifically to technology for promoting easier installation and pre-tensioning of such bolts.

BACKGROUND

Formations, such as rock formations or rock strata, are often reinforced using rock bolts. For example, rock bolts are commonly used for reinforcement of tunnel roofs and for stabilization of rock walls, slopes and dikes. Various types of rock bolts or anchors are used depending for example on the type of formation to be reinforced.

A common type of rock bolt is the hydraulically expandable rock bolt provided with an expandable body to be driven into a formation and thereafter expanded by introduction of a pressurized pressure medium such that the expandable body presses against the wall of the borehole and thereby engages the formation. A hydraulically expandable rock bolt is known from CZ 25706 U1.

Another type of rock bolt is the friction bolt. Such a rock bolt may be driven into a formation by a driving device such as a jumbo. The mechanically expandable bolt comprises an elongate expandable outer body, sometimes referred to as a split-tube, and a central rod extending inside the outer body from a trailing portion provided with a nut to a leading portion operatively connected to an expansion mechanism for expanding the outer body upon rotation of the central rod.

At installation of the mechanically expandable rock bolt in the formation, the driving device is operated to repeatedly impact the outer body of the bolt, thereby forcing the outer body into the formation. When the bolt is sufficiently far driven into the formation the bolt is expanded by operation of the expansion mechanism thereby causing expansion of the outer body.

AU2010223134B2 discloses a mechanically expandable friction bolt.

EP3635220 A1 and WO201513743 disclose prior art mechanically expandable rock bolts.

The holes in the formation may be long and the friction acting on the bolt during the step of driving the bolt into the formation limits how fast and/or how far the bolt can be driven into the hole in the formation.

One example is an installation of bolts longer than three meters, especially when holes are drilled at a bottom diameter of a prescribed standard range of diameters for the bolt, the outer body/split-tube of the bolt may buckle and/or the trailing end of the bolt be damaged by prolonged hammering so that the installation has to be aborted.

Another problem is that some types of installation equipment, particularly handheld air legs, do not have enough power to hammer in the bolts efficiently.

A specific problem of mechanically anchored rock bolts with split-tube and anchoring wedges is that they cannot be used for pre-tensioning of the formation into which the bolt is installed since the outer body/split tube prevents the rock plate from moving closer to the leading end portion of the rock bolt as the central rod of the rock bolt is tensioned.

SUMMARY

An object of the invention is thus to mitigate the above-mentioned problems by promoting easier driving of the bolt into the formation, such as by enabling lower friction between the bolt and the formation at driving of the bolt into the formation. Another object of the invention is to enable pre-tensioning of a mechanically expanded rock bolt, i.e. for pre-tensioning of the formation.

According to a first aspect of the invention, these and other objects are achieved by the rock bolt defined in the embodiments.

The rock bolt comprises a central rod with a threaded leading portion and a trailing portion. The rock bolt also comprises a tubular outer body, sometimes referred to as a split-tube, provided around the central rod. The outer body is provided along at least a portion of the length of the central rod and comprises a leading portion and a trailing portion. The rock bolt also comprises a first wedge means attached to the leading portion of the central rod, and a second wedge means attached to the leading portion of the outer body between the first wedge means and the trailing portion of the outer body. Also, the first wedge means and the second wedge means are configured such that the first wedge means is able to force the second wedge means radially outwards about the longitudinal axis of the rock bolt upon movement of the first wedge means in a direction towards the trailing portion of the central rod to thereby radially expand the outer body.

The leading portion of the outer body is provided with one or more ledge means. Also, the central rod is provided with a drive means configured to drive the ledge means upon movement of the drive means in a driving direction of the rock bolt to thereby force the outer body in the driving direction via the ledge means.

Such configuration of the rock bolt enables the rock bolt to be driven into a hole of a formation by applying a driving force to the central rod rather than to the outer body, thereby transmitting the driving force to the outer body via the first wedge means and the ledge means. The outer body is thereby pulled into the formation from its leading portion rather than pushed into the formation from its trailing portion. By pulling the outer body into the formation by its leading portion, buckling of the outer body is prevented and the force needed to drive the bolt into the formation is reduced. By reducing the force needed to drive the rock bolt into the formation, damages to the trailing end of the rock bolt are mitigated. Also, the reduction of force needed to drive the rock bolt into the formation enables use of weaker driving equipment, such as handheld air legs. Also, since the outer body's main function is to hold the second wedges, and is not used to drive the rock bolt, the dimension of the outer body may be reduced.

The ledge means may comprise one or more protrusions protruding radially inwards within the tubular outer body with respect to the longitudinal axis of the rock bolt.

The protrusions extend radially inwards from the tubular outer body and thereby provide one or more surfaces for the driving means to act on for forcing the outer body into the formation.

Each protrusion may comprise an impact surface extending inside the outer body such that the drive means is able to force the impact surface in the driving direction, wherein the impact surface is supported from the leading end-side of the outer body by a support body extending from the impact surface to the outer body.

By providing a support surface extending inside the outer body, the surface area on which the drive means acts is increased as compared to only using a surface of the outer tube, such as a surface availed by a hole through the wall of the outer tube. The increased surface area reduces local pressure in the interface between the drive means and the ledge means and thus reduces stress on the drive means.

The impact surface and the support body may be formed by a portion of the outer body plastically deformed radially inwards.

By using a portion of the outer body to form the support surface, the number of parts involved are kept low and manufacturing costs are reduced.

The support body and the impact surface may be provided in the form of a separate member attached to the outer body or engaging the outer body.

The use of a separate member for providing the support surface enables a larger support surface and provides a more robust interface between drive means and outer tube enabling more powerful driving impacts.

The separate member providing the impact surface and the support body may be seated in a through hole of the outer body.

Seating the separate member in a through hole of the outer body enables the outer body to transfer driving force to the outer body via one or more edge portions of the through hole.

The separate member providing the impact surface and the support body may be welded to the outer body.

Welding the separate member to the through hole of the outer body gives the separate member a well-defined position relatively the outer body and enables driving forces to be transferred to the outer body not only on the driving side of the separate member, thus reducing local stress in the interface between drive means and outer body.

The outer body may be provided with one or more radial through holes and wherein the first wedge means extend into the radial through holes of the outer body before installation of the rock bolt.

The radial through holes allow the first wedge means to be sized larger by extending into the radial through holes. By sizing the first wedge means larger and into the through holes, the first wedge means is able to radially expand the outer body further at installation of the bolt, thus improving grip of the rock bolt in soft formations.

The drive means may be provided in the form of drive surfaces on the first wedge means.

Providing drive surfaces on the first wedge means, enables the first wedge means to be used for driving of the outer body into the formation by impacting the central rod. Once driven sufficiently into the formation, the central rod is rotated to pull the first wedge means towards the trailing end of the central rod, thereby expanding the outer body. This dual use of the first wedge means reduces the number of parts of the rock bolt, and enables the drive means to act very close to the leading end of the outer body.

The drive means may be provided in the form of a drive member provided on the central rod between the second wedge means and the trailing portion of the outer body, wherein the ledge means is provided in the form of one or more trailing surfaces of the second wedge means.

Rather than using the first wedge means to drive the outer body, a separate drive member can be attached to the central rod somewhere along the leading portion of the outer body. Here, the drive member is attached on the trailing side of the second wedge means, which is used as a ledge means to transfer force from the drive means via the second wedge means and further to the outer body to drive it into the formation.

The drive means may alternatively be provided in the form of a drive member provided on the central rod between the first wedge means and the leading end of the outer body. Also in this configuration, the drive means impacts the outer body close to the leading end of the outer body, thereby pulling most of the outer body into the formation rather than pushing it into the formation.

The drive member may comprise a nut threaded to the central rod.

A drive member in the form of a nut threaded onto the central rod provides a robust and easy-to-produce drive member. Also, the position of the drive member along the central rod can easily be adjusted by rotation of the nut.

The drive member may be configured to engage the outer body to restrict a relative rotational movement between the drive member and the outer body. By restricting or hindering the drive member from rotating relative to the outer body, it can be avoided that the drive member rotates together with the central rod. Instead, the drive member may be enabled to translate along the threading of the central rod upon rotation of the central rod. This way of locking the drive member to the outer body, allowing it to translate along the longitudinal axis but not rotate relative to the outer body, is particularly advantageous should the first wedge means at least partly pass the second wedge means when moving towards the trailing portion. In case at least a portion of the first wedge means protrudes beyond the second wedge means in a direction towards the trailing portion, the first wedge means may be brought in contact with the drive member during the expansion of the leading portion of the outer body. Such a contact between the drive member and the first wedge means risks obstructing the movement of the first wedge means and hence impair the expansion function of the bolt. This may in particular be the case if the friction between the contacting surfaces of the first wedge means and the drive member is lower than the friction of the threaded engagement between the drive member and the central rod. By engaging the drive member to the outer body the drive member is allowed to move away from the second wedge means during the expansion of the leading portion, thereby avoiding contact between the first wedge means and the drive member.

The engagement between the outer body and the drive member may for example be achieved by means of a protrusion arranged on the outer body, extending radially inwards and along the longitudinal axis and configured to engage with a corresponding structure of the drive member. Alternatively, or additionally the drive member may comprise a protrusion extending radially outwards and being configured to engage with a corresponding structure of the outer body to restrict the relative rotational movement.

The rock bolt may further comprise a rock plate and a nut threaded to the trailing portion of the central rod, wherein a washer is provided between the rock plate and the nut for distributing force from the nut to the rock plate. The length of the outer body is such that as the outer body is pulled into a formation at installation of the rock bolt, there is a gap between the trailing end of the outer body and the rock plate.

The rock bolt is driven into the formation by forcing the central rod into the formation, for example using a driver socket on the nut on the trailing end of the central rod to hammer the central rod into the formation. The drive means of the central rod pulls the outer body into the formation along with the central rod. Since the trailing end of the outer body is driven into the formation past the opening of the formation, the trailing end of the outer body will not hit the rock plate as the formation around the rock bolt compacts upon pre-tensioning of the central rod. Without this gap, the outer body would span the full length between the second wedge means and the rock plate, thereby mitigating pre-tensioning of the material of the formation at pre-tensioning of the central rod.

The gap may be within the range of 10 to 300 mm.

This range has proven particularly useful with common sizes of rock bolts having lengths between 1.5 to 4.5 m.

The rock bolt may further comprise a sleeve fitted around the central rod at the trailing portion of the outer body, wherein a first portion of the sleeve extends within the outer body, and wherein a second portion of the sleeve extends through a central hole of the rock plate and further to the washer a predetermined distance D past the trailing end of the outer body.

The sleeve centers the rock plate about the central rod thereby ensuring that the contact between the rock plate and the washer is circumferential even though a gap is present between the rock plate and the trailing end of the outer body. Since the sleeve extends past the trailing end of the outer body, the outer body can be driven into the formation past the opening of the formation whilst the sleeve aligns the rock plate. This enables proper alignment of the rock plate at pre-tensioning of the central rod after expansion of the leading portion of the outer body.

The sleeve may be movable relative to the outer body along the longitudinal axis of the rock bolt, back and forth within an operative range between an inner position and outer position, wherein the outer body and the sleeve are provided with retaining means configured to retain the sleeve within the operative range thereby preventing the sleeve from falling out of the outer body.

By making the sleeve movable, yet retained to the outer body, assembly of the rock bolt is easier, since the sleeve will not be displaced. Also, the movability of the sleeve allows it to move it into the hole of the formation at installation and pre-tensioning of the rock bolt.

The retaining means may comprise a protrusion of the outer body extending radially inwards into a corresponding elongate recess of the sleeve, wherein the protrusion is movable within the confines of the recess as the sleeve moves within the operative range, and wherein the protrusion prevents movement of the sleeve outside of the operative range.

The combination of a tab and a corresponding elongate recess is a robust and easy-to-produce way of providing the retaining means.

The sleeve may be press-fitted to the central rod tight enough for friction between the sleeve and the central rod to prevent the central rod from falling out of the sleeve should the central rod break between the sleeve and the leading portion of the central rod.

Such configuration of the sleeve enables it to prevent a broken central rod from falling out of the formation. Instead, as a rod breaks, the trailing portion of the broken rod will move out slightly before the retaining means catches the sleeve, which in turn catches the central rod and prevents it from moving further out of the formation. Yet, an operator can visually inspect the rock bolt and see that it is broken by looking for any gap present between the rock plate and the formation after installation.

BRIEF DESCRIPTION OF DRAWINGS

Specifically, FIG. 4 shows a window/through hole in this embodiment adjacent the ledge means, said through hole allowing a first wedge means to extend radially outwards into the space in the through holes, thereby enabling a larger first wedge means.

FIG. 5 shows a ledge means provided by through holes in the wall of the outer body availing a leading surface of each respective through holes which the drive means can apply driving force to.

FIG. 6 shows a ledge means formed by a separate member seated in a through hole of the outer body and optionally welded to the outer body around the circumference of the through hole.

FIG. 7 shows a ledge means formed by plastic deformation radially inwards of a portion of the wall of the outer body, similar to the ledge means shown in FIGS. 3 and 4 but not open towards the trailing end of the rock bolt.

FIG. 8 shows the rock bolt being driven into the formation by a driver socket and a sleeve in an outer position. FIG. 9 shows the rock bolt fully driven into the formation and undergoing pre-tensioning of the rock bolt by rotation of the nut pulling the central rod outwards through the nut. In an alternative embodiment, a blind nut could be used instead, wherein the rotation would instead rely on tensioning the rock bolt by screwing a threaded leading portion of the central rod forwards relatively a first wedge attached by threads to the leading portion of the rock bolt. In FIG. 9, it should be noted that the sleeve has moved forward relatively the outer body/split-tube and that the rock plate is forced against the formation. FIG. 10 shows the rock bolt after failure of the central rod between the sleeve and the leading portion of the central rod. Specifically, it should be noted in FIG. 10 that the sleeve has moved out of the formation together with a trailing portion of the central rod and that a retaining means prevent further movement outwards of the central rod, which is held by friction to the sleeve. A gap is visible between the rock plate and the formation, thereby indicating that the rock bolt is broken.

| | |
|---|---|
| 1 | rock bolt |
| 2 | central rod |
| 3 | leading portion of central rod |
| 4 | trailing portion of central rod |
| 5 | outer body |
| 6 | leading portion of outer body |
| 7 | trailing portion of outer body |

-continued

| | |
|---|---|
| 8 | first wedge means |
| 9 | second wedge means |
| 10 | longitudinal axis of rock bolt |
| 11 | ledge means |
| 12 | drive means |
| 13 | driving direction of rock bolt |
| 14 | radial through holes of outer body |
| 15 | drive surfaces on first wedge means |
| 16 | drive member |
| 17 | trailing surfaces of second wedge means |
| 18 | leading end of outer body |
| 19 | rock plate |
| 20 | nut |
| 21 | washer |
| 22 | formation |
| 23 | trailing end of outer body |
| 24 | gap |
| 25 | sleeve |
| 26 | operative range |
| 27 | retaining means |
| 28 | protrusion or retaining means |
| 29 | elongate recess of retaining means |
| 30 | impact surface |
| 31 | support body |
| 32 | separate member forming impact surface and support body |
| 41 | protrusion of outer body |
| 42 | protrusion of drive member |
| 43 | recess in drive member |
| 44 | recess in outer body |
| D | predetermined distance |

DETAILED DESCRIPTION

A rock bolt 1 according to an exemplary embodiment will hereinafter be described with reference to the appended drawings.

Figure 2:
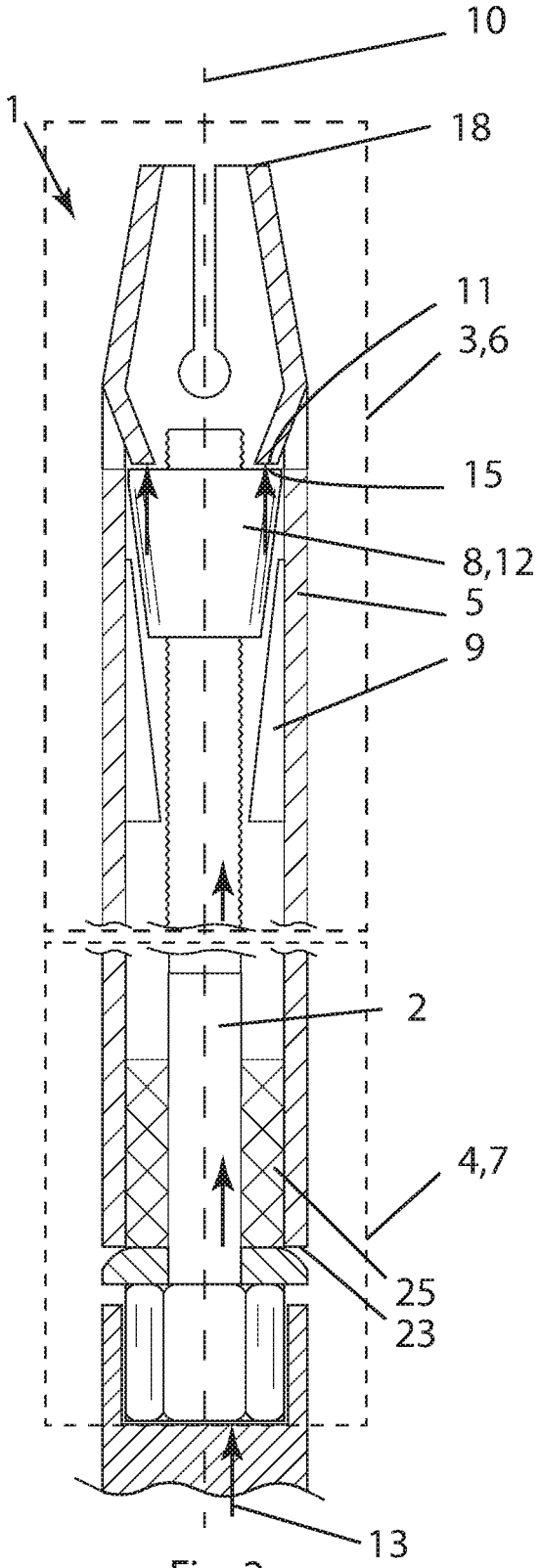
FIG. 2 shows a second embodiment of a rock bolt, wherein the outer body is driven into a formation forced by a first wedge means attached to the central rod acting on ledge means in the form of protrusions of the outer body extending radially inwards.
Figure 3:
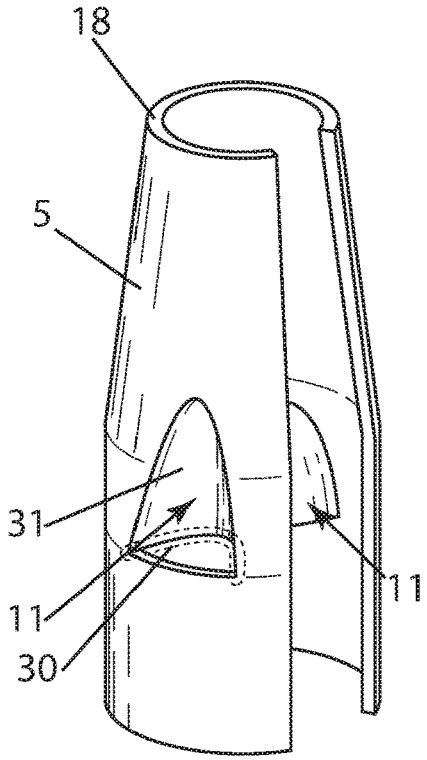
FIGS. 3 and 4 show a front portion of an outer tube provided with ledge means in the form of protrusions extending radially inwards.
Figure 4:
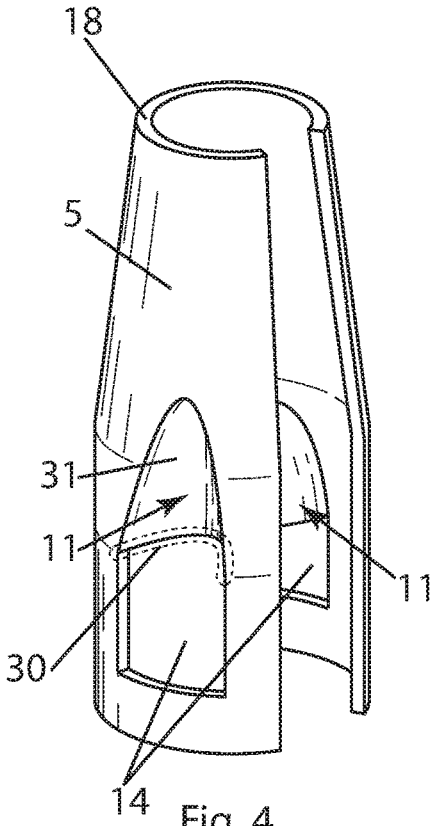

As shown in FIG. 2, the rock bolt 1 comprises a central rod 2 with a threaded leading portion 3 and a trailing portion 4. The rock bolt also comprises a tubular outer body 5 provided around the central rod 2 along at least a portion of the length of the central rod 2, said tubular outer body 5 having a leading portion 6 and a trailing portion 7. A first wedge means 8 is threaded onto the leading portion 3 of the central rod 2. The position of the first wedge relatively the central rod 2 can thus be controlled by rotation of the central rod 2, typically by rotating the trailing portion of the central rod 2 via a blind nut attached to the trailing portion of the central rod 2. The rock bolt also comprises a second wedge means 9 attached to the leading portion 6 of the outer body 5 between the first wedge means 8 and the trailing portion of the outer body 7. The first wedge means 8 and the second wedge means 9 are configured such that the first wedge means 8 is able to force the second wedge means 9 radially outwards about the longitudinal axis 10 of the rock bolt 1 upon movement of the first wedge means 8 in a direction towards the trailing portion 4 of the central rod 2 to thereby radially expand the outer body 5, wherein the leading portion of the outer body 5 is forced against the hole in the formation such that the outer body 5 is secured to the formation. The leading portion of the outer body 5 is provided with two opposing ledge means 11 in the form of protrusions extending radially inwards from a tubular portion of the outer body 5, often referred to as a split-tube. In this embodiment the protrusions are formed by plastically deforming portions of the outer body 5 radially inwards as shown in FIG. 3. Each protrusion of the ledge means 11 comprises an impact surface 30 extending inside the outer body 5 such that the drive means 12 is able to force the impact surface 30 in the driving direction. The impact surface 30 is supported from the leading end-side of the outer body 5 by a support body 31 extending from the impact surface 30 to the outer body 5.

Figure 5:
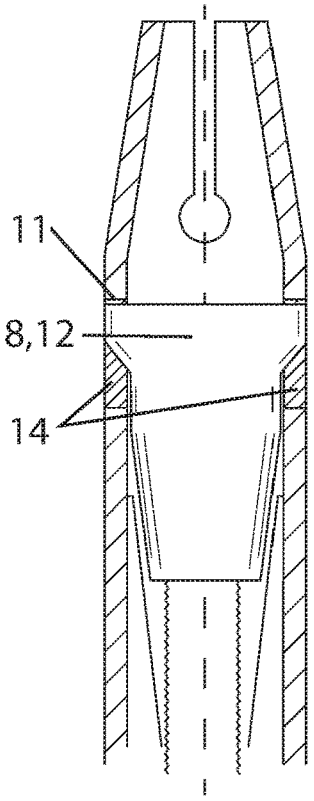
FIGS. 5-7 show various embodiments of the ledge means.
Figure 6:
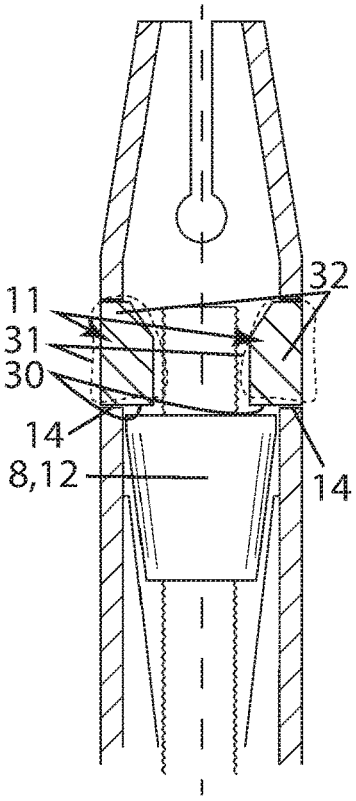
Figure 7:
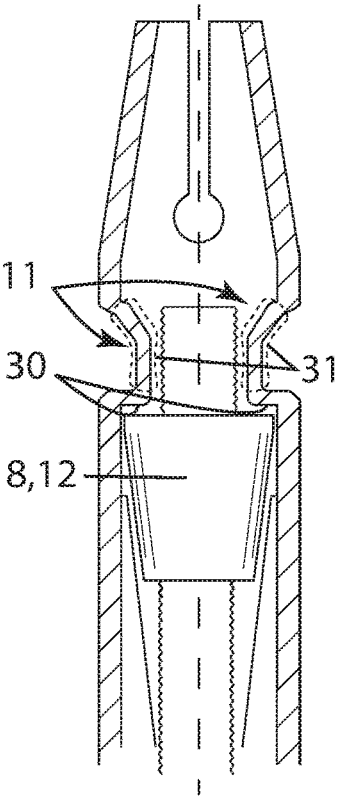
Figure 10:
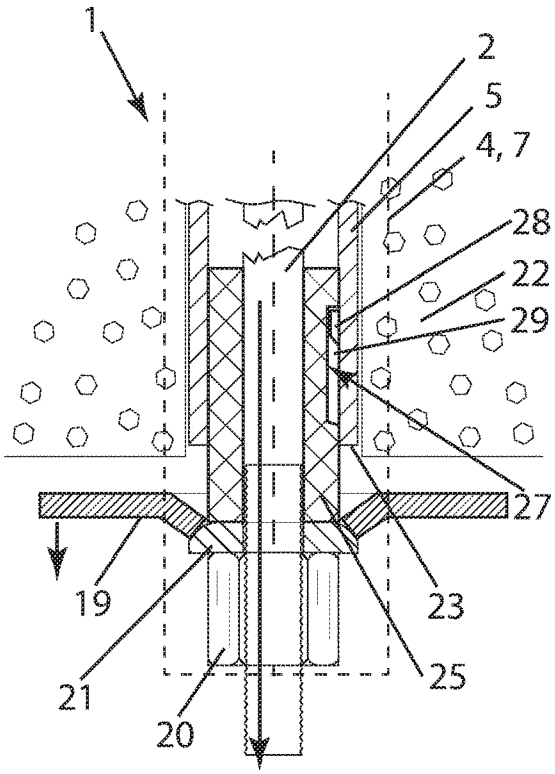
FIGS. 8-10 show a trailing portion of a third embodiment of a rock bolt at different stages of installation of the rock bolt in a formation. Specifically.
Figure 9:
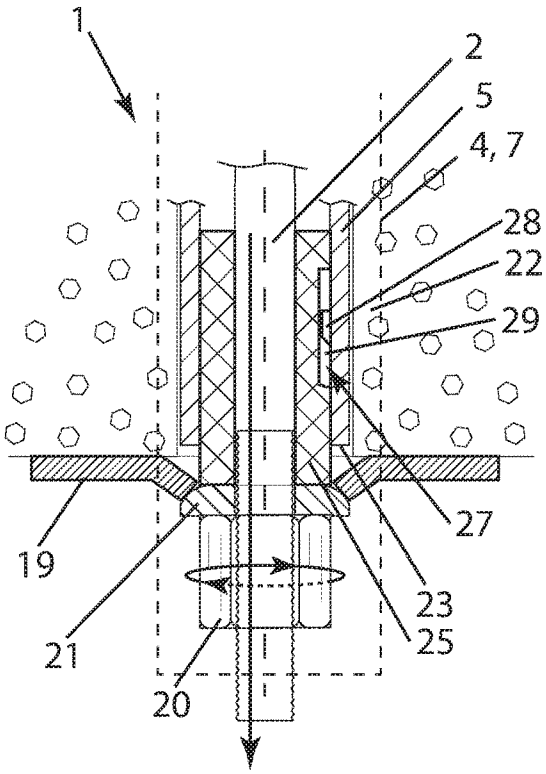
Figure 8:
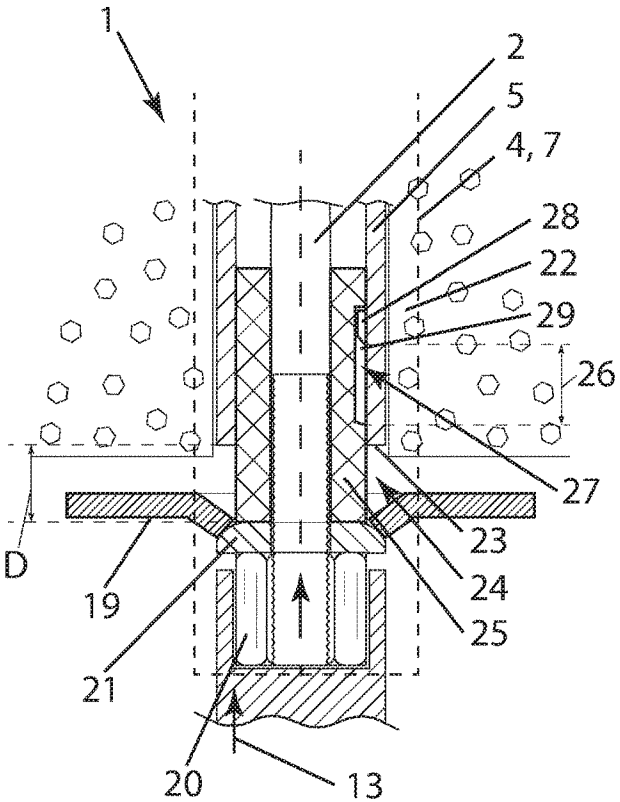

The ledge means 11 may alternatively be configured according to the embodiments shown in FIGS. 5-7 with appropriate changes made to the drive means 12 to interface the ledge means 11.

For example, the support body 31 and the impact surface 30 may be provided in the form of a separate member 32 attached to the outer body 5 or engaging the outer body 5, as shown in FIG. 6.

The separate member 32 is typically seated in a through hole of the outer body 5 and may optionally be welded to the outer body 5. However, the separate member 32 may alternatively in other embodiments be attached to the outer body 5 in any other suitable way not necessarily using seating in a through hole of the outer body 5.

In yet alternative embodiments, the outer body 5 may be manufactured to get the same shape as the outer body 5 and ledge means 11 combination of the embodiment shown in FIG. 6 by forming them together in one piece such as by molding, rather than by adding a separate member to the outer body 5.

Figure 1A:
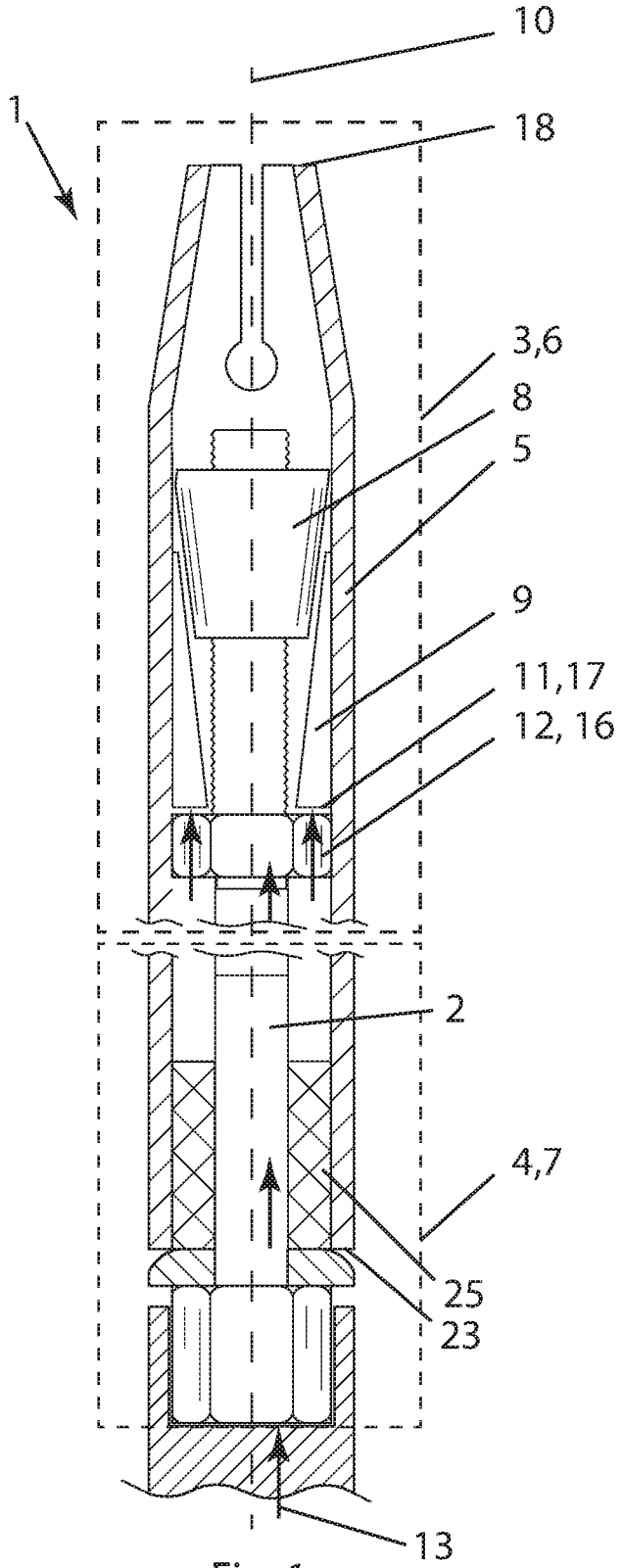
FIG. 1*a* shows a first embodiment of a rock bolt wherein the outer body is driven into a formation via a driving member acting on the trailing portion of second wedges attached to the outer tube.
Figure 1B:
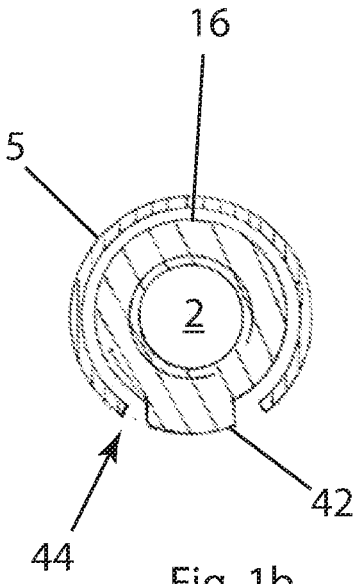
FIGS. 1*b* and *c* show cross sections of the driving member according to FIG. 1*a*.
Figure 1C:
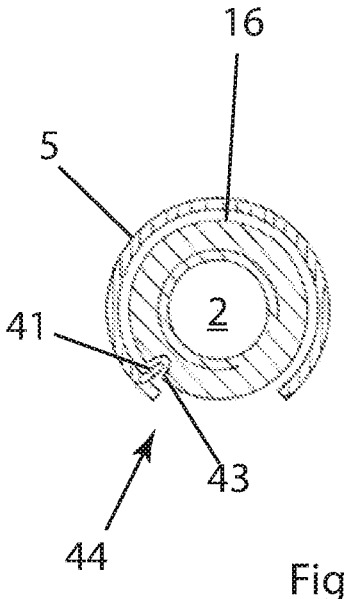

The central rod 2 is provided with a drive means 12 configured to drive the ledge means 11 upon movement of the drive means 12 in a driving direction 13 of the rock bolt 1 to thereby force the outer body 5 in the driving direction 13 via the ledge means 11. In this embodiment, the drive means 12 is provided in the form of drive surfaces 15 on the first wedge means 8 but in other embodiments, the drive means 12 could alternatively be provided on a separate member attached to the central rod 2 at a suitable position along the length of the central rod 2 depending on the position of the ledge means 11 along the length of the outer body 5 as for example shown in the embodiment of FIG. 1*a* where a drive member 16 in the form of a nut is threaded to the central rod 2. In some examples the drive member 16 as illustrated in FIG. 1*a* may be configured to engage the outer body 5 to restrict a relative rotational movement between the drive member 16 and the outer body 5. As illustrated in FIG. 1*b* the engagement may for example be achieved by means of a protrusion 42, such as a lug 42, of the drive member 16, extending radially outwards from the drive member 16 and configured to interlock with a corresponding recess or opening 44 in the outer body 5. FIG. 1*c* illustrates a further example, wherein the drive member 16 comprises a recess 43 into which a protrusion, such as a tube tab 41, of the outer body 5 may be fitted so as to hinder the drive member 16 from rotating relative to the outer body 5. As a result, the drive member 16 can be ensured to move in the axial direction along the threaded central bolt 2 as the central bolt 2 is rotated relative to the drive member 16. Advantageously, this allows for the drive member 16 to be arranged at a certain distance from for instance the first wedge means 8 during the expansion of the outer body 5, thereby avoiding contact between the first wedge means 8 and the drive member 16.

The rock bolt 1 further comprises a sleeve 25 fitted around the central rod 2 at the trailing portion 7 of the outer body 5. In this embodiment, the sleeve extends only within the outer body 5 but in other embodiments, the sleeve could alternatively extend outside the trailing end of the outer body 5.

The sleeve 25 is press-fitted to the central rod 2 tight enough for friction between the sleeve 25 and the central rod 2 to prevent the central rod 2 from falling out of the sleeve 25 should the central rod 2 break between the sleeve 25 and the leading portion 3 of the central rod 2. Such a sleeve is sometimes referred to as a 'stopper'.

The rock bolt 1 is driven installed into a bore of a formation 22 by applying a driving force to the trailing portion 4 of the central rod 2 via the blind nut. The central rod 2 forces the first wedge means 8 forward and thereby pushes on the ledge means 11 of the outer body 5. The force on the ledge means 11 pulls the outer body 5 into the formation 22, thereby moving the outer body 5 into the formation without buckling of the outer body 5. The present design thus reduces the power needed to force the outer body 5 into the formation 22 as compared to prior art designs which are based on applying driving force directly to the trailing portion 7 of the outer body 5.

Once the outer body has been pulled sufficiently far into the formation 22, the central rod 2 is rotated by rotation of the blind nut in order to thereby move the first wedge means 8 towards the second wedge means 9, and thereby force the second wedge means 9 radially outward such that the outer body 5 is expanded and anchored to the formation 22.

In other embodiments, the outer body 5 may additionally be provided with one or more radial through holes 14 and the first wedge means 8 be configured to extend into the radial through holes 14 of the outer body 5 before expansion of the leading portion of the outer tube at installation of the rock bolt. Once, the leading portion of the outer body 5 is expanded, the first wedge means has forced the outer body 5 radially outwards, wherein the wedge means no longer resides in the through holes of the outer body 5. Such a configuration has the advantage that it provides for additional radial expansion of the outer body 5.

The concept of pulling the outer body into the formation by applying a driving force at its leading portion via the central rod 2 may alternatively be realized in other ways, such as the one mentioned above shown in FIGS. 1*a-c* where the drive means 12 is provided in the form of a drive member 16 provided on the central rod 2 between the second wedge means 9 and the trailing portion 7 of the outer body 5, and wherein the ledge means 11 is provided in the form of one or more trailing surfaces 17 of the second wedge means 9. In the FIG. 1*a-c* embodiments, the drive means is a nut threaded to the central rod 2, by the drive means could alternatively have any other suitable form and could alternatively be attached to the central rod 2 in any other suitable way. In yet alternative embodiments, the drive means 12 could be provided in the form of a drive member 16 provided on the central rod 2 between the first wedge means 8 and the leading end 18 of the outer body 5 (not shown in figures).

Another aspect of the invention relates to how to enable pre-tensioning of the formation by pre-tensioning the central rod 2 of the rock bolt. FIGS. 5-7 relate specifically to a disclosure of how the trailing portion of a rock bolt could alternatively be configured to enable such pre-tensioning. As the skilled person would understand, this type of configuration of the trailing portion of the rock bolt 1 is compatible with the other described alternative embodiments of the leading portion of the rock bolt 1 and can thus be applied to the other embodiments in this disclosure. According to FIGS. 5-7, a rock bolt may thus comprise a rock plate 19 and a nut 20 threaded to the trailing portion 4 of the central rod 2, wherein a washer 21 is provided between the rock plate 19 and the nut 20 for distributing force from the nut 20 to the rock plate 19. The length of the outer body 5 is such that as the outer body 5 is pulled into a formation 22 at installation of the rock bolt 1, there is a gap 24 between the trailing end 23 of the outer body 5 and the rock plate 19.

The gap 24 may often be within the range of 10-300 mm, but this range being selected according to the length of the rock bolt and the amount of compaction of the formation deemed necessary for pre-tensioning of the formation. The rock bolt 1 comprises a sleeve 25 fitted around the central rod 2 at the trailing portion 7 of the outer body 5, wherein a first portion of the sleeve 25 extends within the outer body 5, and wherein a second portion of the sleeve 25 extends through a central hole of the rock plate 19 and further to the washer 21 a predetermined distance D past the trailing end 23 of the outer body 5.

The sleeve 25 is movable relative to the outer body 5 along the longitudinal axis 10 of the rock bolt 1, back and forth within an operative range 26 between an inner position and outer position. The outer body 5 and the sleeve 25 are provided with retaining means 27 configured to retain the sleeve within the operative range 26 thereby preventing the sleeve 25 from falling out of the outer body 5. The retaining means 27 comprises a protrusion 28 of the outer body 5 extending radially inwards into a corresponding elongate recess 29 of the sleeve 25, wherein the protrusion is movable within the confines of the elongate recess 29 as the sleeve 25 moves within the operative range 26, and wherein the protrusion prevents movement of the sleeve 25 outside of the operative range 26. In other embodiments, the retaining means could have any other suitable configuration, such as an elongate recess provided in the trailing portion of the outer body 5 and a pin extending through the elongate recess and into the sleeve.

The invention claimed is:

1. A rock bolt comprising:

a central rod with a threaded leading portion and a trailing portion;

a tubular outer body provided around the central rod along at least a portion of a length of the central rod, said tubular outer body having a leading portion and a trailing portion;

a first wedge means attached to the leading portion of the central rod; and a second wedge means attached to the leading portion of the outer body between the first wedge means and the trailing portion of the outer body, wherein the first wedge means and the second wedge means are configured such that the first wedge means is arranged to force the second wedge means radially outwards about a longitudinal axis of the rock bolt upon movement of the first wedge means in a direction towards the trailing portion of the central rod to thereby radially expand the outer body, wherein the leading portion of the outer body is provided with one or more ledge means, and wherein the central rod is provided with a drive means configured to drive the ledge means upon movement of the drive means in a driving direction of the rock bolt to thereby force the outer body in the driving direction via the ledge means.

2. The rock bolt according to claim 1, wherein the ledge means includes one or more protrusions protruding radially inwards within the tubular outer body with respect to the longitudinal axis of the rock bolt.

3. The rock bolt according to claim 2, wherein each protrusion includes an impact surface extending inside the outer body such that the drive means is able to force the impact surface in the driving direction, wherein the impact surface is supported from a leading end-side of the outer body by a support body extending from the impact surface to the outer body.

4. The rock bolt according to claim 3, wherein the impact surface and the support body are formed by a portion of the outer body plastically deformed radially inwards.

5. The rock bolt according to claim 1, wherein the drive means is in a form of drive surfaces on the first wedge means.

6. The rock bolt according to claim 1, wherein the drive means is a drive member provided on the central rod between the second wedge means and the trailing portion of the outer body, and wherein the ledge means is one or more trailing surfaces of the second wedge means.

7. The rock bolt according to claim 6, wherein the drive member is configured to engage the outer body to restrict a relative rotational movement between the drive member and the outer body.

8. The rock bolt according to claim 7, wherein the outer body includes a protrusion extending radially inwards and along the longitudinal axis and being configured to engage with the drive member to restrict the relative rotational movement.

9. The rock bolt according to claim 7, wherein the drive member includes a protrusion extending radially outwards and configured to engage with the outer body to restrict the relative rotational movement.

10. The rock bolt according to claim 6, wherein the drive member includes a nut threaded to the central rod.

11. The rock bolt according to claim 1, further comprising a rock plate and a nut threaded to the trailing portion of the central rod, wherein a washer is provided between the rock plate and the nut for distributing force from the nut to the rock plate, wherein a length of the outer body is such that as the outer body is pulled into a formation at installation of the rock bolt, there is a gap formed between a trailing end of the outer body and the rock plate.

12. The rock bolt according to claim 11, wherein the gap is within a range of 50-100 mm.

13. The rock bolt according to claim 11, further comprising a sleeve fitted around the central rod at the trailing portion of the outer body, wherein a first portion of the sleeve extends within the outer body, and wherein a second portion of the sleeve extends through a central hole of the rock plate and further to the washer a predetermined distance past the trailing end of the outer body.

14. The rock bolt according to claim 13, wherein the sleeve is movable relative to the outer body along the longitudinal axis of the rock bolt, back and forth within an operative range between an inner position and outer position, wherein the outer body and the sleeve are provided with retaining means configured to retain the sleeve within the operative range thereby preventing the sleeve from falling out of the outer body.

15. The rock bolt according to claim 14, wherein the retaining means includes a protrusion of the outer body extending radially inwards into a corresponding elongate recess of the sleeve, wherein the protrusion is movable within confines of the recess as the sleeve moves within the operative range, and wherein the protrusion prevents movement of the sleeve outside of the operative range.

16. The rock bolt according to claim 14, wherein the sleeve is press-fitted to the central rod tight enough for friction between the sleeve and the central rod to prevent the central rod from falling out of the sleeve should the central rod break between the sleeve and the leading portion of the central rod.

* * * * *